United States Patent [19]

Holthoff

[11] 4,353,513

[45] Oct. 12, 1982

[54] WINDING APPARATUS

[75] Inventor: Helmut Holthoff, Düsseldorf, Fed. Rep. of Germany

[73] Assignee: Kocks Technik GmbH & Company, Hilden, Fed. Rep. of Germany

[21] Appl. No.: 209,278

[22] Filed: Nov. 21, 1980

[30] Foreign Application Priority Data

Aug. 27, 1980 [DE] Fed. Rep. of Germany ..... 3002026

[51] Int. Cl.[3] ..... B21C 47/00

[52] U.S. Cl. ..... 242/82

[58] Field of Search ..... 242/82, 83, 47, 47.01, 242/47.02, 174, 176, 178; 19/159 R

[56] References Cited

U.S. PATENT DOCUMENTS

| | | | |
|---|---|---|---|
| 2,997,249 | 8/1961 | Meinshausen | 242/82 |
| 3,638,278 | 2/1972 | Johneis | 19/159 R |
| 3,780,963 | 12/1973 | Hirschfelder | 242/82 |

FOREIGN PATENT DOCUMENTS

| | | | |
|---|---|---|---|
| 1029783 | 2/1956 | Fed. Rep. of Germany | 242/82 |

*Primary Examiner*—Edward J. McCarthy

*Attorney, Agent, or Firm*—Buell, Blenko, Ziesenheim & Beck

[57] ABSTRACT

A winding apparatus is provided for the layering of thin elongated material, especially hot-rolled wire in loop-like windings, in which a doubly or spatially curved laying tube whose longitudinal axis forms a cone-shaped rotation body and whose peripheral speed at the outlet opening matches the entrance speed of the material rotates around a rotation axis, in which case the laying tube is also curved in the peripheral direction of the superficies of the rotation body, the improvement comprising the superficides of the rotation body being curved in an essentially concave manner in accordance with a cycloid beginning at the entrance opening of the laying tube with its vertex, the length of the cycloid resulting from a half-rotation of a rolling circle generated from top to bottom of said rotation body, and that the curvature of the laying tube in the peripheral direction of the superficies is specified by a simultaneously occurring substantially half-rotation of said rotation body around its rotation axis.

25 Claims, 14 Drawing Figures

FIG. 5
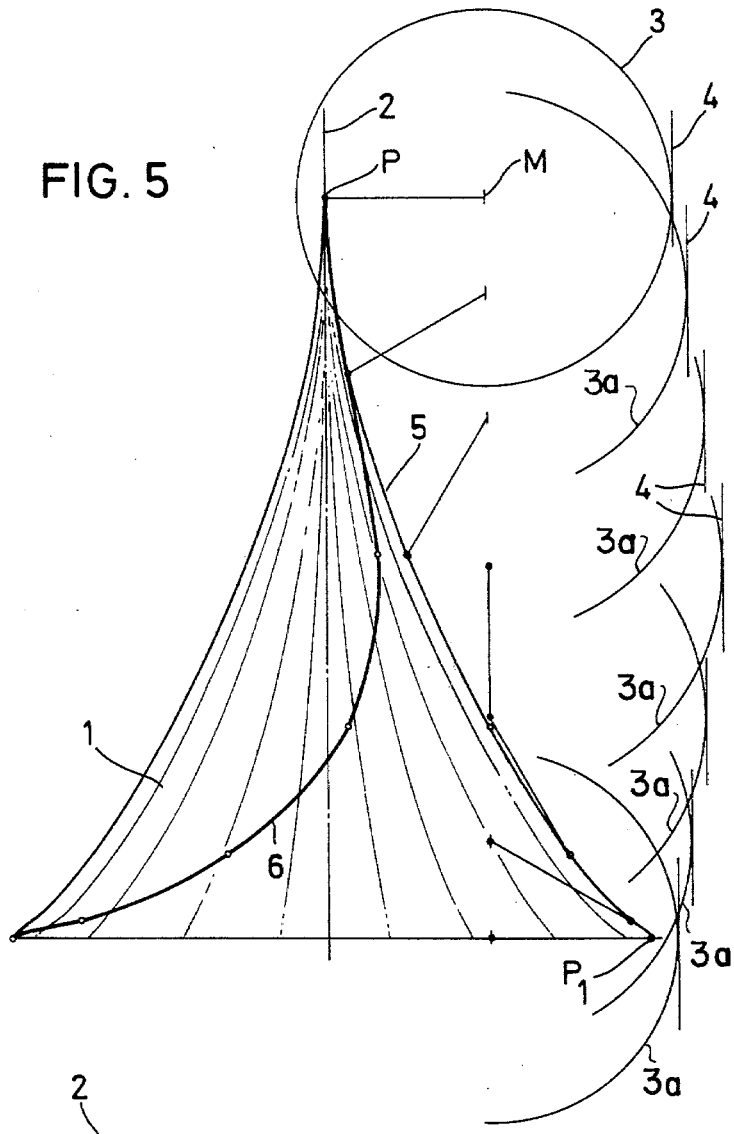
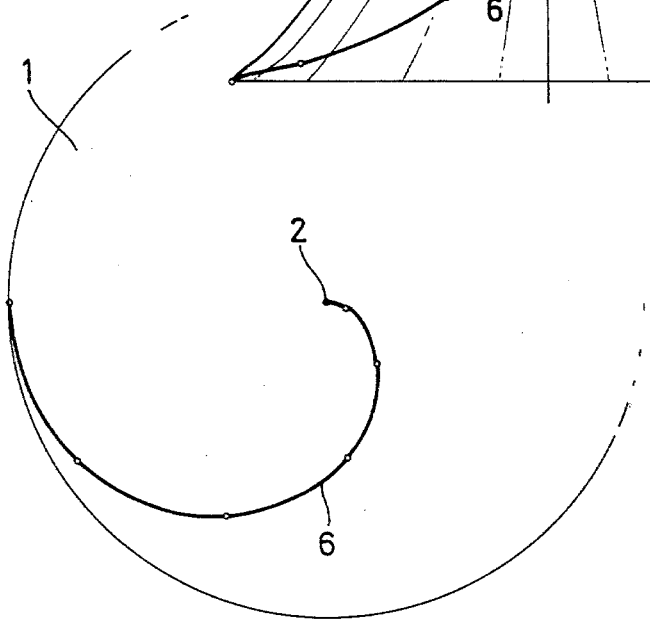
FIG. 6

WINDING APPARATUS

This invention relates to winding apparatus and particularly to a winding apparatus for the layering of thin elongated material, especially hot-rolled wire, in loop-like windings, in which a laying tube with a spatial or double curvature rotates around a rotation axis, its longitudinal axis forming a cone-shaped rotation body and its peripheral speed at the outlet opening matching the inlet speed of the material, in which case the laying tube also has a curvature in the peripheral direction of the superficies of the rotation body.

Such winding apparatuses are known as Edenborn coilers and have long been used, especially in the cooling sections for hot-rolled wire. With such winding apparatuses it is possible to brake the high speed of the material down toward zero and to layer the material in coils. The cone-shaped rotation body is generally not perceptually present, but rather it is theoretically formed by the rotation of the laying tube around the longitudinal axis. It serves here for an unambiguous description of the spatial or double curvature of the laying tube. The laying tube extends not only in its longitudinal direction, by which the cone-shaped rotation body is generated during its rotation, but it is also curved in the peripheral direction of the superficies of the rotation body.

In the familar winding apparatuses of this type (DE-PS no. 73,100) its shape is empirically determined and the material is not optimally guided. Thus, there are always perturbations, primarily at high speeds of the material, e.g., at 50 meters per second or higher, in which case the critical speed is naturally dependent on the type of material. In the case of rolled wire, perturbations occur in the portion of the cooling section lying in front of the winding apparatus and in the wire rolling mill lying in front of that; they are evidently caused by the winding apparatus if the acceleration and retardation impulses received by the wire in the laying tube of the winding apparatus are felt as far back as in the wire rolling mill. This is all the more true, the higher the rolling speed. Perturbations of this type cause more prolonged stoppages of the entire installation and quite adversely affect its economy of operation. Another disadvantage is the substantial laying tube wear, which results in frequent replacement and corresponding interruptions in operation.

The invention proposes a winding apparatus of the above-described type, one that operates reliably even at high passage speeds of the material and does not impart impulses to the material such that perturbations arise in the preceding sections of the installation.

This goal is achieved in accordance with the invention in that the superficies of the rotation body is curved in an essentially concave manner in accordance with a cycloid beginning at the inlet opening of the laying tube with its vertex, the length of the cycloid resulting from a half-rotation of the rolling circle produced, and that the curvature of the laying tube in the peripheral direction of the superficies is specified by a simultaneously occurring precise or approximately half-rotation of the rotation body around its axis. The inlet opening of the laying tube is generally located in the region of the cross-sectional plane in which the wire is first turned aside and braked, since it is only from this plane on that a laying tube is required. The above definition of the inlet opening follows because structural types are known in which the laying tube begins in front of the said cross-sectional plane, in which case this laying tube section is straight and rotates around its longitudinal axis. The laying tube according to the invention on the other hand involves only the section between the above-defined inlet opening and the outlet opening, although it can also have a previous laying tube section as an extension in front of the inlet opening. An extension of the laying tube at the outlet end is also possible. The extension then describes a helix or screw line. Only the internal cross section of the laying tube that lies on the said cross-sectional plane is always designated here as the inlet opening of the laying tube.

With the design according to the invention, the wire has to traverse only an optimally short path, on which it is slowed down and looped into coils. The wire does not need to traverse any additional movements that would further stress it. In addition, the acceleration forces acting on the wire during its passage through the laying tube are maintained quite constant so that the force acting on the wire also remains as low as possible. Any unnecessary acceleration or slowdown would in effect signify an additional force acting on the wire. Furthermore, the shape of the laying curve, which is advantageous for the above reasons, is unambiguously established by a mathematical function and the laying tubes according to the invention can always be prepared with a high precision. In passing through the laying tube according to the invention, the wire is consequently quite sparingly deviated from its original straight direction of movement, brought into the form of coils, and braked from its high speed, all of which takes place quite uniformly. All this leads to a very tranquil, material-sparing passage of the wire, i.e., without impulses that cause perturbations in the preceding installation. Wear on the laying tube is also perceptibly reduced.

In an initial implementation of the invention, the superficies of the rotation body is curved in the manner of an ordinary cycloid, the rolling circle diameter of which is equal to half the maximum diameter of the rotation body. In this implementation the generating point of the cycloid lies on the rolling circle. A particularly short laying tube and thus small dimensions of the winding apparatus are obtained. The latter has a vertical rotation axis and the overall height of the structure is low. Also, at the outlet opening of the laying tube the velocity component in the direction of the rotation axis is zero. Thus, this implementation form is particularly well suited for winding apparatuses with vertical or approximately vertical rotation axes. The coils fall only by their own weight on the repository located underneath, which essentially eliminates undesirable deformations.

On the other hand, it is also advantageous if the superficies of the rotation body is curved in the manner of a cranked or curved cycloid. In this case, the point generating the cycloid lies inside of the rolling circle. The further inward this point lies, the greater is the residual speed of the material at the outlet opening of the laying tube in the direction of the rotation axis. This is advantageous, above all, if the rotation axis of the winding apparatus runs relatively flat or even horizontal, because then the finished coils are automatically removed from the laying tube due to this residual speed in the direction of the rotation axis and they do not need to be shoved out by the following coils, which could result in their entanglement.

In the two above implementation forms, which are distinguished by the form of the cycloid, the rolling circle of these cycloids runs on a line parallel to the rotation axis. Just as the rotation body, the rolling circle is not objectively present in practice either, but only in theory. It serves here for a precise determination of the form of the rotation body according to the invention and thus the laying tube.

In another implementation form of the invention the cycloid is formed by an infinitely large number of rolling circles, of which the two rolling circles assigned to the inlet and outlet openings of the laying tube have the smallest diameters and the diameters of the intermediate rolling circles are increasingly larger with increasing distance from the two first-mentioned rolling circles, up to two-fold, preferably up to 1.4 to 1.5-fold, in which case their centers are located on a line parallel to the rotation axis. The relative speed of the point generating the cycloid is thus everywhere identical, by which the slowing down of the wire in the laying tube is even more uniform. Each mass point or center of inertia of the wire remains in this implementation form of the winding apparatus inside of a stationary plane that extends in the direction of the rotation axis and through it and thus is one of the infinitely many conceivable longitudinal median planes that intersect the rotation body in the longitudinal direction. In this case the diameter of the rolling circle becomes larger during the movement from the inlet opening and then becomes smaller up to the outlet opening of the laying tube. The center of the rolling circle remains here on a line parallel to the rotation axis, while an infinitely large number of planes, which all run parallel to the rotation axis, are used as the pay-out plane due to the varying diameter of the rolling circle. The distance of the generating point from the center of the particular rolling circle remains constant here. In this manner, the additional acceleration caused by a fast advance of the wire and which still arises in the implementation forms treated above is also eliminated. The already quite uniform slowing down of the wire through the fundamental concept of the invention is thus even further improved.

In the last-mentioned implementation form, the diameters of the two rolling circles assigned to the inlet and outlet openings can be equal to half the maximum diameter of the rotation body. On the other hand, it is also possible that the diameters of the two rolling circles assigned to the inlet and outlet openings are larger than half the maximum diameter of the rotation body.

In the theoretical ideal case the diameter of the wire is naturally equal to the internal diameter of the laying tube. Of course, this cannot be carried out in practice because the wire would stick in the laying tube due to friction. Consequently, a laying tube internal diameter that is substantially larger than the outside diameter of the wire is chosen; however, the result of this is that the longitudinal median axis of the laying tube, which forms the rotation body, no longer corresponds to the longitudinal axis of the wire. The latter is also the case because wires of different diameter are to be shaped into coils with the same laying tube. Therefore, it is recommended that the deviations of the longitudinal median axes of the material from that of the laying tube be taken into account in the shaping of the laying tubes by shifting their longitudinal median axes radially to the rotation body in the laying tubes with internal diameters that are substantially larger than the outside diameter of the material. In this manner it can at least be somewhat assured that the longitudinal median axis of the wire lies on the superficies of the rotation body.

In another invention design the laying tube consists of a number of short tube sections and/or individual rolls that are placed and held in a curved holder, e.g., a groove, or arranged on a revolution body. The revolution body mentioned here is not the same as the rotation body because it can be designed completely differently than the precisely determined rotation body. The only requirement imposed on the revolution body is that it holds the individual components forming the laying tube such that the longitudinal median axis of the laying tube resulting forms the rotation body during rotation.

It is also recommended to apply a lubricant, in particular, a water-compressed air mixture in the form of a mist, to the inside of the laying tube. In this manner and also by the use of suitable wear-resistant materials the friction inside the laying tube can be substantially reduced.

The invention also concerns an arrangement for producing the winding apparatus, in particular, for the production of the laying tube. This arrangement is characterized by a molded body that matches the rotation body of the laying tube if the latter is reduced in size toward the inside and increased in size toward the outside everywhere around the outside half-diameter of the laying of the laying tube normal to its surface and by the fact that the molded body has the lateral stops corresponding to the curvature of the laying tube in the peripheral direction of the superficies of the rotation body. Pieces of tube can be pressed against these lateral stops, which are also shifted laterally around the outside half-diameter of the laying tube with reference to the longitudinal median axis of the laying tube, such that they acquire the shape of the laying tube according to the invention. If the molded body somewhat represents an outer cone, it is reduced in size inward with reference to the rotation body. If it perhaps forms an inner cone, it is enlarged outward with reference to the rotation body. In the case of the outer cone, the tube is acted upon from the outside for bending or, in the case of an inner cone, it is pressed from the inside against the wall of the molded body. The lateral stops can consist here of a number of stop pins or posts.

The arrangement can also be characterized by a base into which a groove corresponding to the form of the laying tube is effected and whose bottom and side surfaces are shifted around the outside half-diameter of the laying tube with reference to the longitudinal median axis of the laying tube. The base does not correspond here to the molded body or the rotation body, but can be designed quite arbitrarily. The laying tube is formed by insertion into the groove. In the latter implementation form of the production arrangement an outer body with an inner surface matching the outer surface of the base can be slipped over it and this outer body forms, with a groove forming the laying tube, a closed channel in the base. During the production of the laying tube it is drawn or pushed either cold or hot into the groove.

The invention is illustrated in the drawings by means of several implementation examples.

FIGS. 5 and 6 show the side and top views of a rotation body with laying tube curve, using a curved cycloid of rolling circles of varying size.

Figure 1:
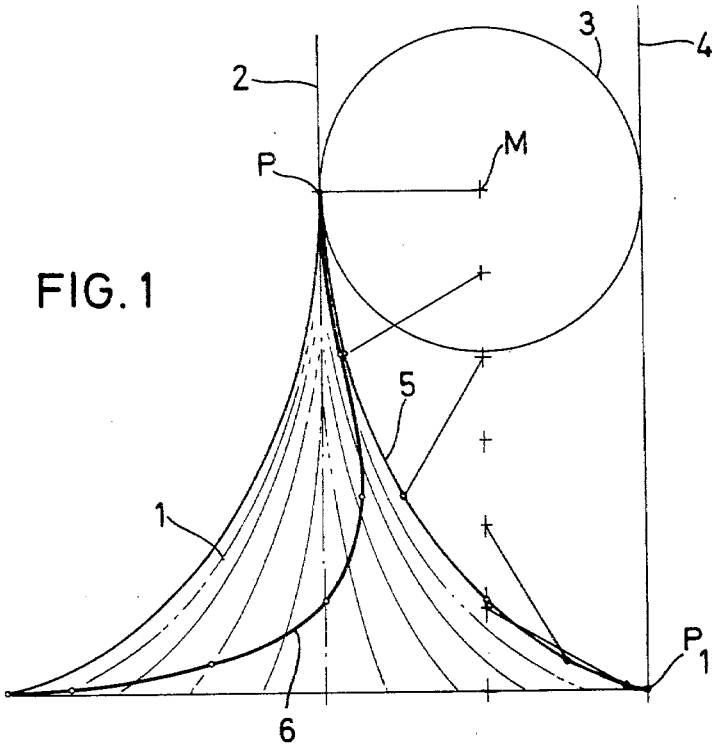
FIGS. 1 and 2 show the side and top views of a rotation body with laying tube curve, using an ordinary cycloid.
Figure 2:
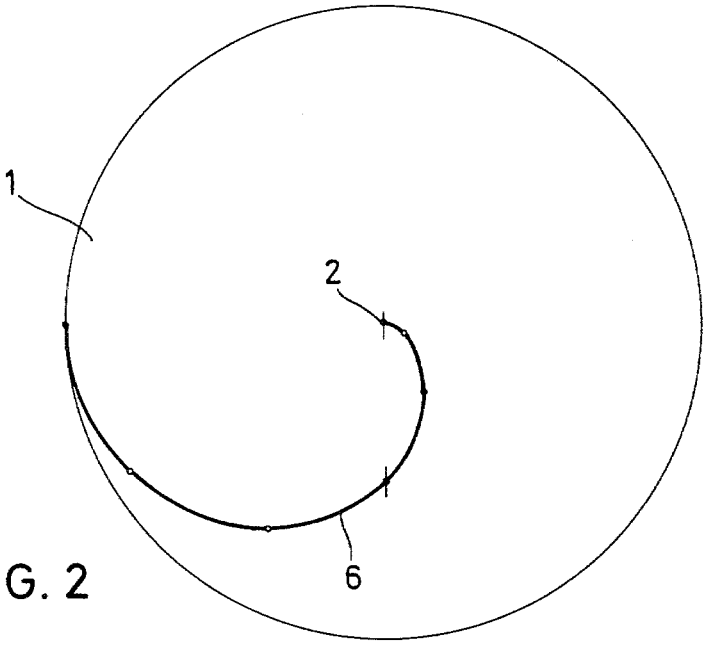

A rotation body that has a rotation axis 2 is designated by 1 in FIGS. 1 and 2. A rolling circle, designated by 3, whose diameter is half the maximum diameter of the rotation body 1, runs on a straight line 4, which extends parallel to the rotation axis 2, at a distance that again corresponds to half the maximum diameter of the rotation body 1.

If one considers a point P on the rolling circle 3 during its rolling on the line 4, in which case the rolling circle 3 moves from top to bottom, which is represented by the larger number of rolling circles 3 plotted, a curve 5 then arises; it is usually designated as an ordinary cycloid. This forms the shape of the superficies of the rotation body 1. The curvature of a laying tube curve 6, which is particularly discernible in FIG. 2, lies on the generatrix or surface line of the rotation body 1, and is curved in the peripheral direction, acquires its curvature through the fact that during the rolling of the rolling circle 3 from point P to point $P_1$ the rotation body 1 at the same time revolves through 180 degrees. The point P then moves along the cycloid 5, i.e., on the superficies of the rotation body 1, and at the same time describes the laying tube curve 6 on this superficies. The laying tube curve 6 is identical with the longitudinal median axis of the laying tube according to the invention (not shown here).

Figure 3:
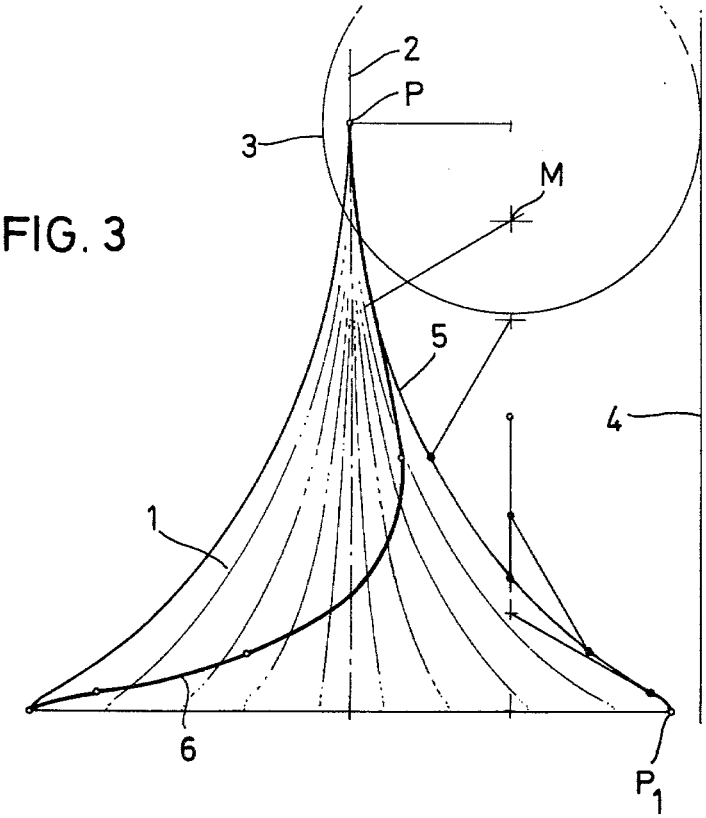
FIGS. 3 and 4 show the side and top views of a rotation body with laying tube curve, using a curved cycloid.
Figure 4:
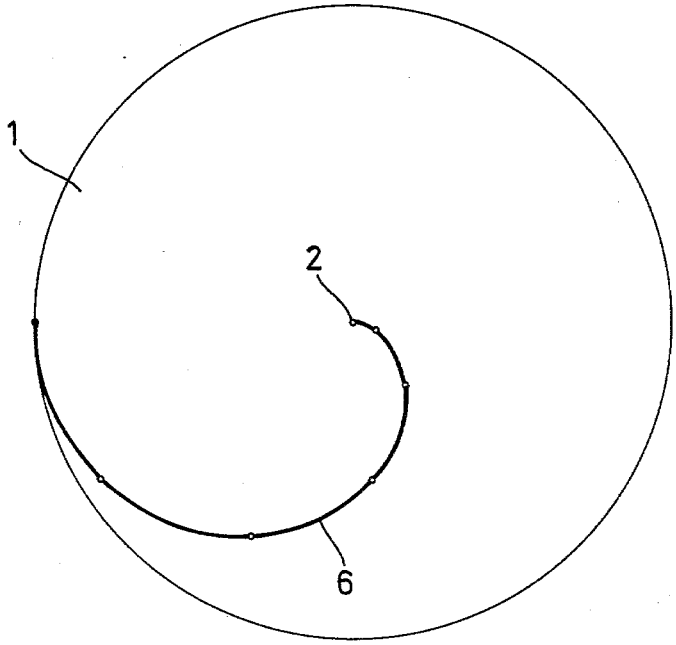

Accordingly, the same is true for FIGS. 3 and 4; therefore, the same reference numbers were used. In contrast to FIGS. 1 and 2, however, a rolling circle 3 whose diameter is larger than half the maximum diameter of the rotation body 1 was used here. The rolling line 4 is correspondingly further from the rotation axis 2 and the point P that produces the cycloid 5 no longer lies on the rolling circle 3, but inside of it, in which case however the distance from the center of the rolling circle (designated by M) always remains the same. As the rolling circle 3 rolls on the line 4, a curved cycloid 5 results if the point P is observed during the rolling. At the same time, the rotation body 1 that thus results also rotates and the laying tube curve 6 arises as in FIGS. 1 and 2. Because the wire entrance speed at the inlet opening must be equal to or approximately equal to the peripheral speed of the rotation body 1 and this would not be the case with an identical angular velocity of rolling circle 3 and rotation body 1, the rotation body 1 must run faster, i.e., traverse an angle larger than 180 degrees during the running time, which is clearly discernible in FIG. 4.

FIGS. 5 and 6 differ from FIGS. 1 through 4, which have been discussed up to this point, by the fact that the diameters of the rolling circles 3 in the region of points P and $P_1$, i.e., at the upper and lower ends of the rotation body 1, are of equal size and correspond to the implementation form according to FIGS. 3. However, the rolling circle diameter increases with increasing distance from point P, by 1.4–1.5 times or more. From approximately the middle of the rotation body height it then gradually decreases. The theoretically infinite number of rolling circles thus resulting roll on a theoretically infinite number of lines 4, of which a few of them with pertinent largest rolling circles **3*a* are shown in FIG. 5. The centers M of all the rolling circles 3 lie on a common straight line that runs parallel to the rotation axis 2, as is also the case in the implementation forms according to FIGS. 1 and 3. In addition, the distance between the rolling circle centers M and the point P producing the cycloids 5 are always of equal length. A laying tube curve 6** that results in an even more uniform slowing down of the wire thus arises.

Figure 7:
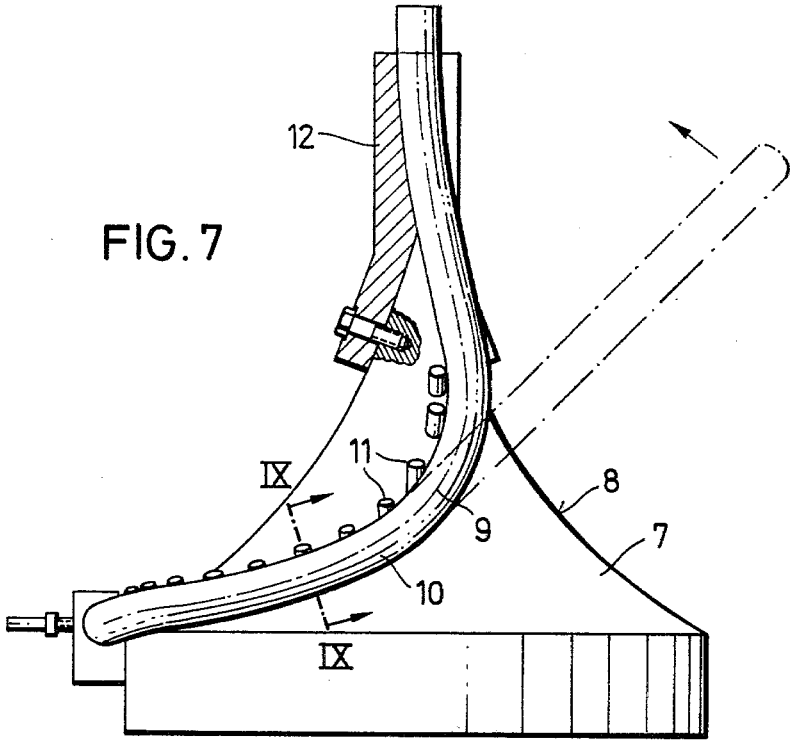
FIGS. 7 and 8 show the side and top views of an arrangement for producing a laying tube.
Figure 8:
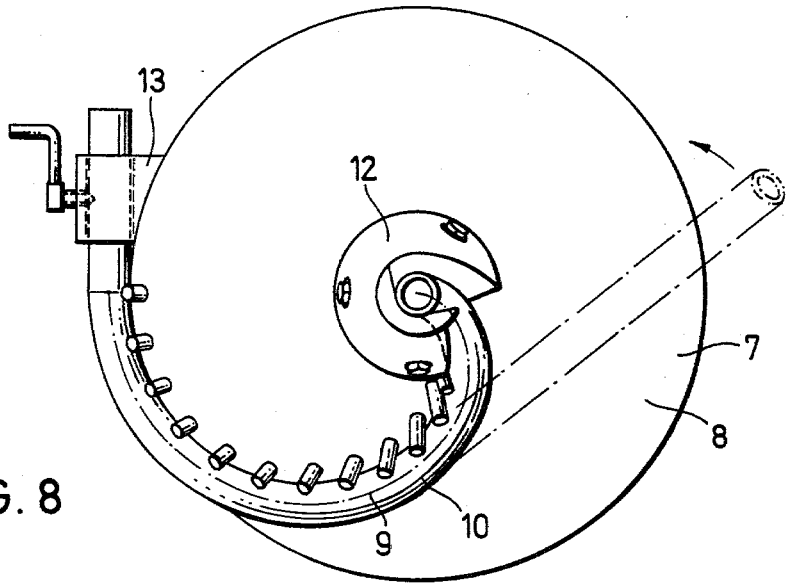
Figure 9:
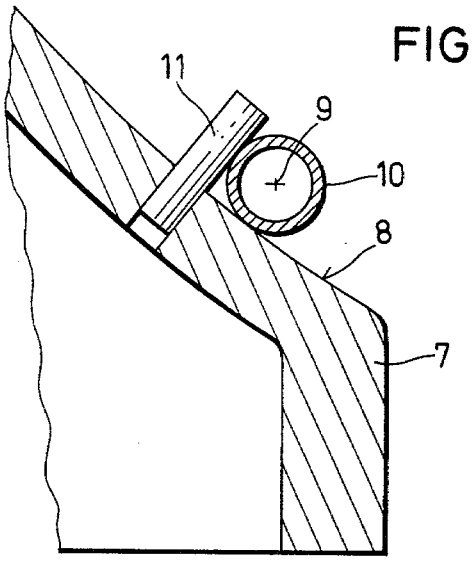
FIG. 9 shows a section along line IX—IX of FIG. 7.

The bending arrangement shown in FIGS. 7 and 8 has a molded body 7, which corresponds approximately to the rotation body 1, but the superficies 8 of the molded body is shifted inward by the outside half-diameter of the laying tube with reference to the superficies of the rotation body 1 normal to this superficies. As a consequence of this, the longitudinal median axis of the laying tube 10 (designated by 9) lies on the superficies of rotation body 1 (not shown in FIG. 7). In the implementation form according to FIGS. 7, 8, and 9 the curvature of the laying tube 10 is determined in the peripheral direction by lateral stops 11 that consist of stop pins. These stop pins are also shifted laterally so that the longitudinal median axis 9 of the laying tube 10 corresponds precisely to the laying tube curve 6, as can be seen in FIGS. 1 through 6. With a shaped part 12 and a holding piece 13 the two end sections of the laying tube 10 are brought during bending into the proper form corresponding to the laying tube curve 6. An inner cone can also be used instead of the outer cone shown in FIG. 7.

Figure 10:
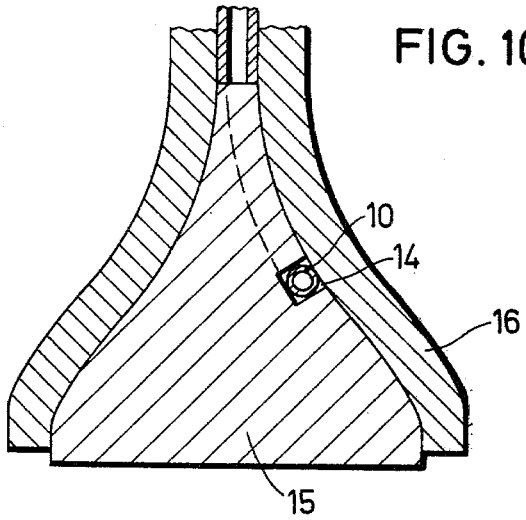
FIG. 10 shows another implementation form of the arrangement in median longitudinal section.

The implementation form according to FIG. 10 shows an arrangement in which the lateral stops consist of the side surfaces of a groove 14 matching the form of the laying tube, in which case the groove 14 is effected in a base 15, over which an outer body 16 can be slipped so that a channel forming the laying tube 10 is formed by the groove 14 and the outer body 16. The base 15 does not need to match the rotation body 1 or the molded body 7 here.

Figure 11:
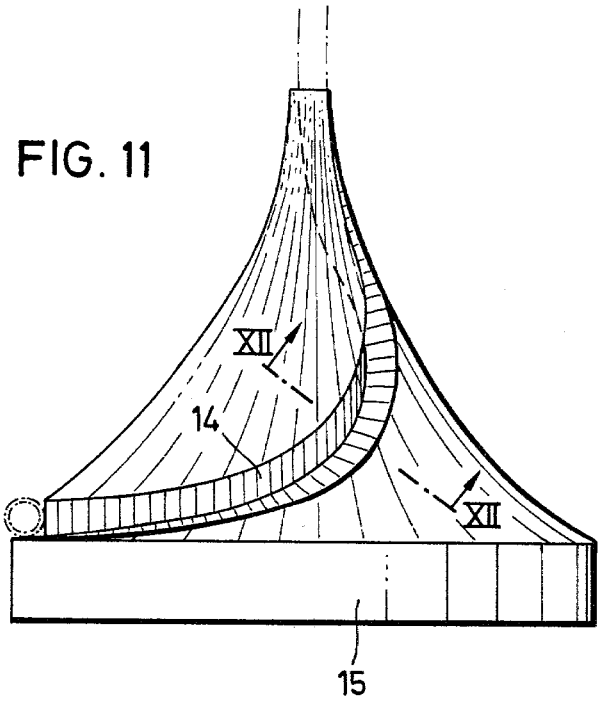
FIG. 11 shows an additional implementation form of the arrangement in the side view.
Figure 12:
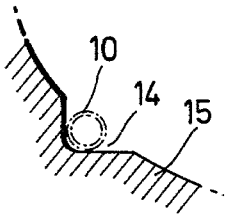
FIG. 12 shows a section along line XII—XII of FIG. 11.

The latter is also true for the arrangement according to FIGS. 11 and 12, where the groove 14 is milled into the base 15. The form and position of the bottom and side surfaces of this groove 14 are such that a laying tube 10, if it is pressed into the groove 14, acquires a longitudinal median axis 9 that corresponds to the form according to the invention.

Figure 13:
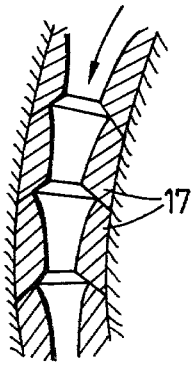
FIG. 13 shows a laying tube segment consisting of several short tube segments in median longitudinal section.

In FIG. 13 the laying tube section shown there consists of a number of short tube sections 17, which may be comprised of wear-resistant materials, such as hard metal, highly wear-resistant steels, and possibly also of ceramic materials, and which are brought into a curved holder, e.g., a groove, and held there. This groove must then, as in FIG. 10, be designed such and/or effected in a revolution body so that the longitudinal median axis of the groove corresponds to the laying curve 6.

In all the above implementation forms a correction that causes the wire to pass as precisely as possible on the curve 6 of the laying tube 10 is expedient in the case of great differences between the internal diameter of the laying tube and the diameter of the wire.

Figure 14:
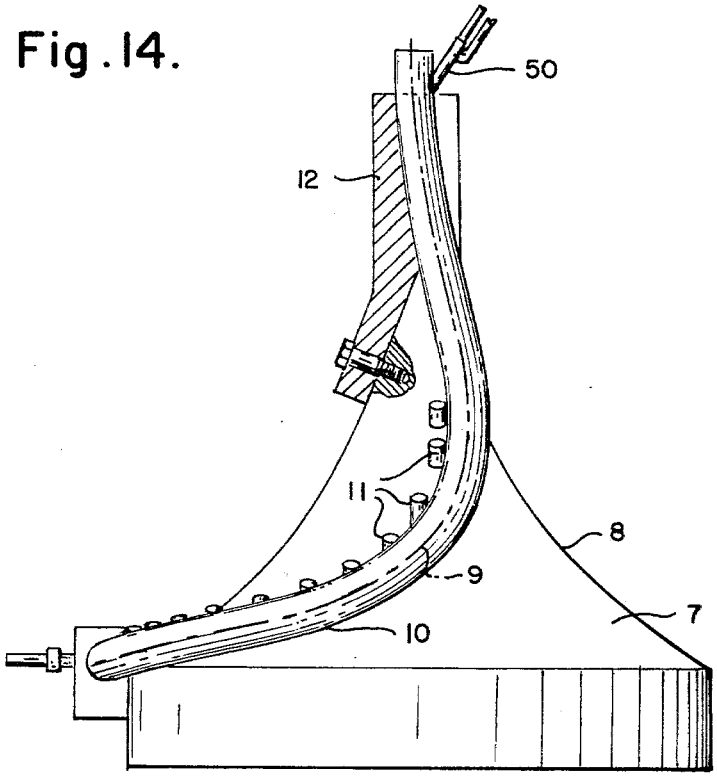
FIG. 14 shows a laying tube segment with means for providing a lubricant mist.

In FIG. 14 there is illustrated a laying tube with a jet 50 in the sidewall providing a mist of lubricant in the form of water and compressed air.

In the foregoing specification I have set out certain preferred embodiments and practices of this invention, however, it will be understood that this invention may be otherwise embodied within the scope of the following claims.

I claim:

1. In a winding apparatus for the layering of thin elongated material, especially hot-rolled wire, in loop-like windings, in which a doubly or spatially curved laying tube whose longitudinal axis forms a cone-shaped rotation body and whose peripheral speed at the outlet opening matches the entrance speed of the material rotates around a rotation axis, in which case the laying tube is also curved in the peripheral direction of the superficies of the rotation body, the improvement comprising the superficies of the rotation body being curved in an essentially concave manner in accordance with a cycloid beginning at the entrance opening of the laying tube with its vertex, the length of the cycloid resulting from a half-rotation of a rolling circle generated from top to bottom of said rotation body, and that the curvature of the laying tube in the peripheral direction of the superficies is specified by a simultaneously occurring substantially half-rotation of said rotation body around its rotation axis.

2. Winding apparatus according to claim 1, characterized in that the superficies of the rotation body is curved in accordance with an ordinary cycloid, whose rolling circle diameter is equal to half the maximum rotation body diameter.

3. Winding apparatus according to claim 1, characterized in that the superficies of the rotation body is curved in accordance with a curved cycloid.

4. Winding apparatus according to claims 2 or 3, characterized in that the rolling circle rides on a line parallel to the rotation axis.

5. Winding apparatus according to claim 1, characterized in that the cycloid is formed by an infinitely large number of rolling circles, of which the two rolling circles assigned to the entrance and outlet openings of the laying tube (10) have the smallest diameter and the diameters of the intermediate rolling circles (3) are increasingly larger with increasing distance from the first two rolling circles (3) up to two-fold, preferably 1.4–1.5-fold, in which case their rolling circle centers are located on a line parallel to the rotation axis.

6. Winding apparatus according to claim 5, characterized in that the diameters of the two rolling circles assigned to the inlet and outlet openings are equal to half of the maximum rotation body diameter.

7. Winding apparatus according to claim 5, characterized in that the diameters of the two rolling circles assigned to the inlet and outlet openings are larger than half of the maximum rotation body diameter.

8. Winding apparatus according to claim 1 or claim 2, or claim 3 or claim 5, or claim 6, or claim 7 characterized in that in the case of laying tubes with internal diameters that are substantially larger than the outside diameters of the material, the deviations of the longitudinal axes of the material from those of the laying tube are taken into account in the designing of the laying tube by shifting its longitudinal axes radially to the rotation body.

9. Winding apparatus according to claims 1, 2, 3, 5, 6, 7, characterized in that the laying tube consists of one of a number of short tube sections and individual rolls that are inserted and held in one of a curved holder and a revolution body.

10. Winding apparatus according to claims 1, 2, 3, 5, 6, 7, characterized in that the laying tube is acted upon on the inside by a lubricant, in particular, a mixture of water and compressed air in the form of a mist.

11. Winding apparatus as claimed in claim 4, characterized in that the laying tube consists of one of a number of short tube sections and individual rolls that are inserted and held in one of a curved holder and a revolution body.

12. Winding apparatus as claimed in claim 4, characterized in that the laying tube is acted upon on the inside by a lubricant, in particular, a mixture of water and compressed air in the form of a mist.

13. Apparatus for the production of a winding apparatus laying tube according to claims 1, 2, 3, 5, 6, 7, comprising a forming body which corresponds to the rotation body of the laying tube reduced in size toward the inside around the outside half diameter of the laying tube normal to its surface and lateral dogs matching the curvature of the laying tube and offset half, the diameter thereof in the peripheral direction of the superficies of the rotation body.

14. Apparatus for the production of a winding apparatus laying tube according to claim 4 comprising a forming body which corresponds to the rotation body of the laying tube reduced in size toward the inside around the outside half diameter of the laying tube normal to its surface and lateral dogs matching the curvature of the laying tube and offset half, the diameter thereof in the peripheral direction of the superficies of the rotation body.

15. Apparatus according to claim 13 wherein the lateral dogs consist of a number of stop pins or posts.

16. Apparatus for production of a winding apparatus laying tube according to claims 1, 2, 3, 5, 6, 7 comprising a forming body which corresponds to the rotation body of the laying tube and a groove in said body matching the shape of the laying tube is formed, the bottom and side faces of which groove are spaced on half the diameter of the laying tube from the center axis of the tube on the rotation body.

17. Apparatus for production of a winding apparatus laying tube as claimed in claim 4 comprising a forming body which corresponds to the rotation body of the laying tube and a groove in said body matching the shape of the laying tube is formed, the bottom and side faces of which groove are spaced one half the diameter of the laying tube from the center axis of the tube on the rotation body.

18. Apparatus according to claim 16 wherein an outer body member having an inner surface that matches the outer surface of the forming body is placed over the forming body, said outer body having a groove corresponding to and matching the groove in the forming body whereby to form a closed channel which forms the laying tube.

19. Winding apparatus according to claim 8 characterized in that the laying tube consists of one of a number of short tube sections and individual rolls that are inserted and held in one of the curved holder and a revolution body.

20. Winding apparatus according to claim 8 characterized in that the laying tube is acted upon on the inside by a lubricant, in particular, a mixture of water and compressed air in the form of a mist.

21. Apparatus for the production of a winding apparatus laying tube according to claim 8 comprising a forming body which corresponds to the rotation body of the laying tube reduced in size toward the inside around the outside half of the laying tube normal to its surface and lateral dogs matching the curvature of the laying tube and offset half, the diameter thereof in the peripheral direction of the superficies of the rotation body.

22. Apparatus for production of a winding apparatus laying tube according to claim 8 comprising a forming body which corresponds to the rotation body of the laying tube and a groove in said body matching the shape of the laying tube as formed, the bottom and side faces of which grooves are spaced with half the diameter of the laying tube from the center axis of the tube on the rotation body.

23. Winding apparatus according to claim 4 characterized in that in the case of laying tubes with internal diameters that are substantially larger than the outside diameters of the material, the deviations of the longitudinal axes of the material from those of the laying tube are taken into account in the designing of the laying tube by shifting its longitudinal axes radially to the rotation body.

24. Apparatus according to claim 14 wherein the lateral dogs consist of a number of stop pins or posts.

25. Apparatus according to claim 17 wherein an outer body member having an inner surface that matches the outer surface of the forming body is placed over the forming body, said outer body having a groove corresponding to and matching the groove in the forming body whereby to form a closed channel which forms the laying tube.

* * * * *

UNITED STATES PATENT AND TRADEMARK OFFICE

CERTIFICATE OF CORRECTION

PATENT NO. : 4,353,513

DATED : October 12, 1982

INVENTOR(S) : HELMUT HOLTHOFF

It is certified that error appears in the above-identified patent and that said Letters Patent are hereby corrected as shown below:

On the title page:

In the Abstract, tenth line, "superficides" should read --superficies--.

Column 6, line 3, "FIGS. 3" should read --FIG. 3--.

Signed and Sealed this

Eighth Day of March 1983

[SEAL]

*Attest:*

GERALD J. MOSSINGHOFF

*Attesting Officer*

*Commissioner of Patents and Trademarks*